United States Patent [19]

Nagasaka et al.

[11] Patent Number: 4,769,185

[45] Date of Patent: Sep. 6, 1988

[54] DIAPHRAGM CARBURETOR FOR INTERNAL COMBUSTION ENGINE

[75] Inventors: Kohji Nagasaka, Kawasaki; Yoshimi Sejimo, Urayasu, both of Japan

[73] Assignee: Walbro Far East, Inc., Kawasaki, Japan

[21] Appl. No.: 84,894

[22] Filed: Aug. 13, 1987

[30] Foreign Application Priority Data

Sep. 30, 1986 [JP] Japan ..... 61-232960

[51] Int. Cl.[4] ..... F02M 17/04

[52] U.S. Cl. ..... 261/35; 261/DIG. 68; 261/DIG. 81

[58] Field of Search ..... 261/35, DIG. 68, DIG. 81

[56] References Cited

U.S. PATENT DOCUMENTS

| | | | |
|---|---|---|---|
| 3,177,920 | 4/1965 | Phillips | 261/DIG. 68 |
| 3,235,238 | 2/1966 | Martin et al. | 261/DIG. 68 |
| 3,738,622 | 6/1973 | Tuckey | 261/DIG. 68 |
| 4,271,093 | 6/1981 | Kobayashi | 261/DIG. 68 |
| 4,597,915 | 7/1986 | Nagase et al. | 261/DIG. 81 |

FOREIGN PATENT DOCUMENTS

| | | | |
|---|---|---|---|
| 59-103948 | 6/1984 | Japan | 261/DIG. 81 |
| 61-132761 | 6/1986 | Japan | 261/DIG. 81 |

*Primary Examiner*—Tim Miles

*Attorney, Agent, or Firm*—Barnes, Kisselle, Raisch, Choate, Whittemore & Hulbert

[57] ABSTRACT

A diaphragm carburetor with a fuel metering chamber designed for easy restart when hot which includes a separate escape chamber connected to the metering chamber having a second diaphragm controlled exhaust valve. The second diaphragm is subject to positive crankcase pressure during engine operation to maintain the exhaust valve closed. When the engine is stopped, the exhaust valve is opened by a spring and fuel in the metering chamber will move into the escape chamber and out of the carburetor rather than be forced into the fuel mixing passage and venturi of the carburetor.

1 Claim, 1 Drawing Sheet

DIAPHRAGM CARBURETOR FOR INTERNAL COMBUSTION ENGINE

FIELD OF INVENTION

The present invention particularly relates to a diaphragm carburetor for the internal combustion engine having a good hot restartability.

BACKGROUND AND OBJECTS OF THE INVENTION

Generally, hot restartability of a small internal combustion engine provided with a diaphragm carburetor is not good for several reasons mentioned below:

(1) A metering chamber is heated by heat of the engine, atmosphere heat, radiant heat of sunshine and the like after the engine has been suspended. This occurs particularly after operation with high load under a burning sun in a summer season. If the metering chamber is heated as described above, fuel having a low boiling point interiorly stored is changed into vapor and flows from a fuel passage to an air inlet and a venturi portion. At the same time, liquid fuel also flows out and together, remains as a mixture of vapor and liquid in the air inlet and venturi, and may flow into a crankcase depending on the attitude of the engine.

(2) Particularly, in the 15 to 20 minute period or so after the engine has been stopped, the fuel in the metering chamber completely flows into the air inlet, and the interior is filled only with fuel vapor.

(3) When the recoil starter is pulled (roping) to restart the engine, fuel remaining in the air inlet and venturi portion is taken into the engine all at once and supplied in the form of a super-rich mixture. Therefore, the engine will not start.

Particularly, at the time of restarting the engine in 15 to 20 minutes after the engine has been stopped, the engine is still in a hot state requiring no rich-mixture, and therefore, when the super-rich mixture is supplied, the engine is more difficult to start.

(4) In such a state as described above, pulling the recoil starter is carried out for several times to discharge the overrich mixture, and the initial explosion can be effected only when fuel in the interior of the cylinder is in the range of combustion.

(5) When a throttle valve is opened and roping is effected at a start position, a mixture may be exhausted with fewer pulls on the starter rope to effect the initial explosion. However, since the throttle valve is open, venturi pressure is so low as not to be able to pull vapor out of the metering chamber, and even if the initial explosion is effected, the engine will not continue running but soon stops. Even if roping is effected over and over again thereafter, the engine will not start.

(6) In the case where the throttle valve is in the idling position, roping has to be repeated over and over again to exhaust the rich mixture. A spark plug may become covered with the mixture depending on the displacement of the engine and the position of the ignition plug, sometimes preventing restart.

(7) The outflow of fuel to the air inlet and venturi portion from the metering chamber after the engine has been stopped makes it difficult to provide hot restart whether the throttle valve is in an open position or in the idling position.

(8) When the choke valve is used under conditions when the engine is hot, fuel remaining in the air inlet is supplied in even a richer condition to the engine, and therefore the engine is even more difficult to restart.

As one means for solving these problems noted above, the present applicants have previously proposed a restarting fuel supply device provided with a diaphragm carburetor for the internal combustion engine, in which a jet is provided in the midst of a hose connecting an upper opening of a fuel tank and an opening of an intake pipe adjacent to an air inlet of the engine. An air intake is provided downstream of the jet, the air intake and the jet being normally closed, and at the restart under high temperature, the air intake and the jet are opened and at the same time, air is introduced from the outside to the bottom portion internally of the fuel tank through a check valve, said air being introduced as bubbles from a porous member to the inside of the fuel.

In the above-described restarting fuel supply device provided with a diaphragm carburetor for the internal combustion engine, even if the engine is in the high temperature state existing after the operation of the engine has been stopped or the like, the opening and closing valve of the restarting fuel supply mechanism may be opened to thereby supply fuel gas (vapor) at the upper portion of the fuel tank together with air taken from the air inlet to the intake pipe downstream of the carburetor. However, in the aforesaid restart state, since the intake passage is low in intake pressure, it is not possible to draw the fuel vapor satisfactorily, and, in addition, no means has been provided for preventing fuel remaining in the metering chamber from flowing into the intake passage after the engine has been stopped and the fuel in the metering chamber has been heated by the heat of the engine or environmental heat. Thus, super-rich fuel is supplied to the intake passage at the time of restart, and the hot restartability of the engine is not always good.

For achieving the aforementioned object of improvement in hot restartability, the present invention provides an arrangement wherein a diaphragm valve is provided in an escape chamber in communication with a metering chamber, said diaphragm valve being adapted to close the escape chamber by positive pressure of the engine during operation of the engine and to open the escape chamber into atmosphere by the force of a spring when the engine is not operating.

BRIEF DESCRIPTION OF THE DRAWINGS

A drawing accompanies the disclosure and is described as follows.

DETAILED DESCRIPTION OF THE INVENTION AND OPERATION

Figure 1:
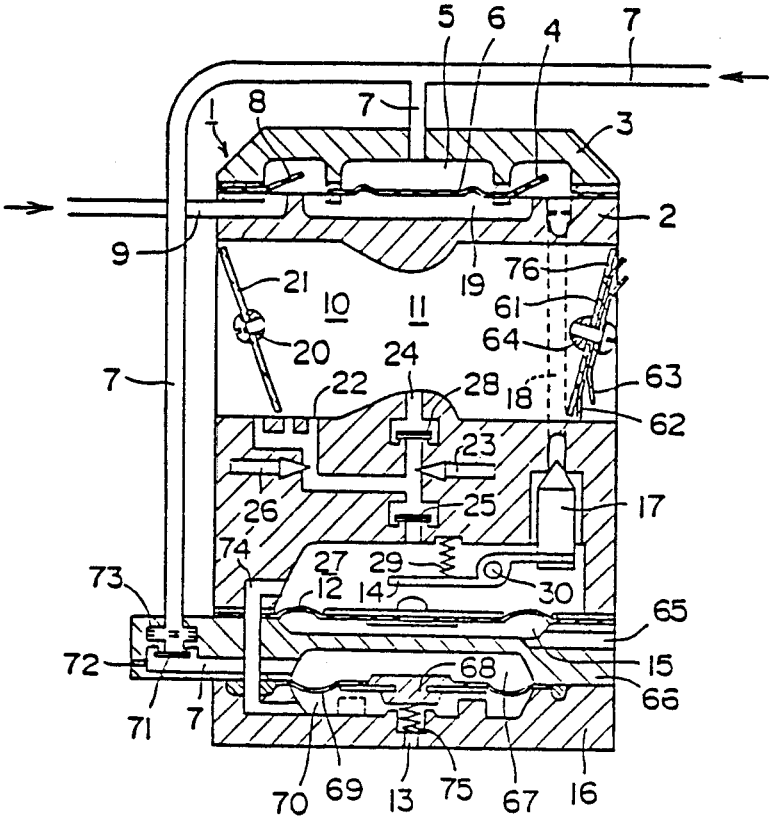
FIG. 1, a side sectional view of a diaphragm carburetor for the internal combustion engine according to the present invention.

Since a diaphragm valve 68 causes an atmospheric port 13 to be closed by positive pressure of a crank chamber during operation of the engine, a metering chamber 27 is not at all affected, and the engine operates normally. When the engine is stopped, the positive pressure acting on the diaphragm 68 ceases to exist, and therefore the diaphragm valve 68 is moved by the force of a spring 75 to open the atmospheric port 13. Accordingly, even if fuel in the metering chamber 27 is expanded, the fuel is not injected into a venturi portion 11 but is exhausted from the atmospheric port 13 via the diaphragm valve 68. Thereby, an engine-start-difficulty resulting from superrich fuel remaining in the venturi portion 11 at the time of restarting the engine is overcome.

In restarting the engine, a choke valve 61 is fully closed, and the metering chamber 27 is filled with fuel by a single pull of the recoil starter rope, after which the choke valve is opened prior to further pulls. Then, since the metering chamber 27 is filled with fuel, restarting may be accomplished easily and thereafter operation of the engine may be continued smoothly.

As shown in FIG. 1, a cover 3 is connected with an interposed diaphragm 6, to the upper wall of a carburetor body 2 provided with venturi 11 in an intake passage 10, and a connection body 66 is connected, with an interposed diaphragm 12, to the lower wall thereof.

A pulsating pressure inlet 7 provided in the cover 3 is connected to a crank chamber of a two-cycle engine (not shown) and the pulsating pressure acts on the diaphragm 6 of a pulsating pressure inlet chamber 5 constituting a fuel pump. A fuel chamber 19 defined by the diaphragm 6 is connected to an inlet 9 through a check valve 8, and is connected to a metering chamber 27 through a check valve 4, a passage 18 and an inlet valve 17.

An atmospheric chamber 15 between diaphragm 12 defining the metering chamber 27 and the connection body 66 is opened into atmosphere through an atmospheric port 65. Inlet valve 17 in the form of a needle valve is disposed at the end of a passage 18 and is opened and closed by means of a lever 14, that is, one end of the lever 14, pivotally supported on the wall of the metering chamber 27 by means of a shaft 30, is biased into engagement with the end of the inlet valve 17 by the pressure of spring 29. The other end of the lever 14 abuts on a projection connected generally in the center of the diaphragm 12. The metering chamber 27 is connected to a high speed fuel jet 24 of the intake passage 10 and is connected to a low speed fuel jet 22 through a low speed fuel metering valve 26. Check valves 25 and 28 are provided in the fuel passage leading from the diaphragm chamber 27 to the low speed and high speed jets.

According to the present invention, the pulsating pressure inlet chamber 67 is divided from the chamber 70 by the diaphragm 69 sandwiched between the connection body 66 and the cover 16, and the escape chamber 70 is connected to the metering chamber 27 via a passage 74 and is brought into communication with the atmospheric port 13 through the diaphragm valve 68.

A spring 75 is interposed between the cover 16 and the diaphragm valve 68. The pulsating pressure inlet chamber 67 is connected to a leak hole 72 via a passage 7 and comes into communication with atmosphere, the chamber 67 being further connected to the crank chamber of the engine through a check valve 71, a screen 73 and the passage 7.

A throttle valve 21 supported on a valve shaft 20 is disposed in an intake passage 10. At an upstream position of the intake passage 10, more specifically at an upstream position away from the venturi portion 11, a choke valve 61 supported on a valve shaft 64 is formed with notches 76 in the form of leak holes at both upper and lower ends of a disk-like plate. A valve plate 62 formed of a temperature responsive alloy and a back-up plate 63 are superposed on the choke valve 61, and, in the event the atmospheric temperature is low, the edge of the valve plate 62 formed of the temperature responsive alloy is closely superposed on the choke valve 61 so as to close the notches 76. However, this structure has no direct relation with the subject matter of the present invention and will not be further described.

Next, the operation of the diaphragm carburetor for the internal combustion engine according to the present invention will be described.

In a manner similar to a conventional diaphragm carburetor of the same kind, fuel in a fuel tank, not shown, is supplied, by the diaphragm operated by the pulsating pressure of the crank chamber of the engine, to the metering chamber 27 through a check valve 8, fuel chamber 19, check valve 4, passage 18, inlet valve 17 and the like. However, fuel pressure in the chamber 27 is maintained at a predetermined level by the spring 29 acting on the lever 14 pivotally moved about the shaft 30. The diaphragm 12 is exposed on its lower surface to atmospheric pressure through passage 65. The fuel is injected into the intake passage 10 through the low speed fuel metering needle valve 26 or high speed fuel metering needle valve 23, according to the position of the throttle valve 12, and supplied to the engine.

During operation of the engine, the screen 73 and the check valve 71 are forced opened and only the positive pressure of the crank chamber is introduced from the pulsating pressure inlet pipe 7 into the pulsating pressure inlet chamber 67, and the diaphragm valve 68 supported on the diaphragm 69 causes the atmospheric port 13 to be closed against the force of the spring 75.

After the engine has been stopped, the diaphragm carburetor 1 is heated, and fuel in the metering chamber 27 is expanded due to an increase in temperature of the metering chamber 27 and flows into the escape chamber 70 via the passage 74. On the other hand, as the engine stops, pressure in the pulsating pressure inlet chamber 67 gradually reduces to atmospheric pressure via the leak hole 72, and therefore the diaphragm 69 is raised under the action of the force of the spring 75 so that the escape chamber 70 comes into communication with the atmospheric port 13. In this way, fuel in the metering chamber 27 is discharged outside through the passage 74, the escape chamber 70 and the atmospheric port 13 to prevent the outflow of fuel and vapor from the metering chamber 27 to the intake passage 10.

According to the present invention, even if the engine is stopped, the heated fuel vapor in the metering chamber is automatically discharged outside. Therefore, the restarting of the engine may be accomplished extremely easily even by an unskilled person who is not aware of the characteristics of the diaphragm carburetor of this kind.

In restarting the engine, the choke valve 61 is fully closed and the metering chamber 27 is filled with fuel by a single pull of the recoil starter rope, after which the choke valve 61 is opened and further starting pulls are initiated. Then, in this case, since the metering chamber 27 is filled with fuel, restarting may be easily accomplished, and thereafter operation of the engine may be continued smoothly.

According to the present invention, as described above, fuel can be furnished in a manner similar to a conventional diaphragm carburetor for the internal combustion engine, and in addition the following effects may be obtained:

(1) Since an exhaust valve is provided in relation to the metering chamber of the diaphragm carburetor to close the metering chamber during operation of the engine and to open the chamber into atmosphere during stoppage of the engine, fuel in the metering chamber is not forced toward the air inlet after the engine has been stopped, and the hot restartability of the engine is not deteriorated.

(2) Since fuel in the metering chamber is discharged into atmosphere after the engine has been stopped and fuel in the metering chamber is not forced into the intake passage, the choke valve is closed, at the time of hot restarting, and the recoil is pulled once whereby the metering chamber can be filled with fuel in a proper ratio of mixture. Subsequently, when the choke valve is opened and the recoil is pulled, fuel may be supplied to the engine so that the latter may be easily restarted.

(3) Since the construction is so simple that the exhaust valve is provided in relation to the metering chamber to be closed during operation of the engine and opened during stoppage of the engine, the present invention may be easily adapted to existing carburetors.

(4) As described above, since the pressure on the diaphragm carrying the exhaust valve is great, even if a diaphragm carburetor is used for an internal combustion engine, for example, for a chain saw which is subject to great vibration and generates a large quantity of dust, a stabilized operation without trouble may be maintained.

Moreover, the present invention may be applied also to a diaphragm carburetor provided with a primer pump or the like which forcibly supplies fuel to the metering chamber at the time of starting the engine.

What is claimed is:

1. A diaphragm carburetor for an internal combustion engine comprising diaphragm means forming a fuel metering chamber, a fuel escape chamber in communication with said metering chamber, passage means communicating said escape chamber with the atmosphere, and spring-biased, diaphragm-operated valve means controlling flow through said passage means and operated in response to positive pressure generated by the engine to close said valve means during engine operation and to open said valve means when the engine is inoperative.

* * * * *